US005331339A

United States Patent [19]

Takahashi

[11] Patent Number: 5,331,339

[45] Date of Patent: Jul. 19, 1994

[54] INK JET PRINTER

[75] Inventor: Naoshi Takahashi, Hitachi, Japan

[73] Assignee: Hitachi, Ltd., Tokyo, Japan

[21] Appl. No.: 31,194

[22] Filed: Mar. 12, 1993

[30] Foreign Application Priority Data

Mar. 12, 1992 [JP] Japan ..... 4-053263

[51] Int. Cl.[5] ..... B41J 2/18

[52] U.S. Cl. ..... 349/89

[58] Field of Search ..... 346/75

[56] References Cited

U.S. PATENT DOCUMENTS

| | | | |
|---|---|---|---|
| 3,761,953 | 9/1973 | Helgeson et al. | 346/75 |
| 3,929,071 | 12/1975 | Cialone et al. | 346/75 X |
| 3,930,258 | 12/1975 | Dick et al. . | |
| 4,083,053 | 4/1978 | Ouchi et al. . | |
| 4,292,640 | 9/1981 | Lammers et al. | 346/75 |
| 4,403,229 | 9/1983 | Barteck | 346/75 |
| 4,575,735 | 3/1986 | Weinberg | 346/75 X |
| 4,614,948 | 9/1986 | Katerberg et al. | 346/75 |
| 4,658,268 | 4/1987 | Needham | 346/1.1 |
| 4,734,711 | 3/1988 | Piatt et al. | 346/75 |
| 4,827,278 | 5/1989 | Lecheheb | 346/75 X |
| 5,189,438 | 2/1993 | Hine et al. | 346/1.1 |

FOREIGN PATENT DOCUMENTS

| | | |
|---|---|---|
| 123523 | 10/1984 | European Pat. Off. . |
| 60-11364 | 1/1985 | Japan . |
| WO9117052 | 11/1991 | PCT Int'l Appl. . |

*Primary Examiner*—George H. Miller, Jr.

*Attorney, Agent, or Firm*—Antonelli, Terry, Stout & Kraus

[57] ABSTRACT

An ink-jet printer comprises, an ink tank for receiving an ink, a printing head including a nozzle for injecting an array of ink-particles, electrode means for charging the ink-particles with electricity, electrically controllably energized deflecting means for deflecting the electrically charged ink-particles so that each of the ink-particles injected from the ink-jet printer reaches a desirable position on a work piece to be printed, and a gutter for receiving a part of the array of ink-particles which is not used to print the work piece, and pump means for taking the part of the array of ink-particles through the gutter into the ink tank, wherein an air in the printing head is taken into the pump means through the gutter, and the ink-jet printer further comprises a feed back path which opens to an inside of the printing head at an outside of the gutter to return the air taken from the printing head by the pump means through the gutter to the inside of the printing head at the outside of the gutter.

14 Claims, 10 Drawing Sheets

INK JET PRINTER

BACKGROUND OF THE INVENTION AND RELATED ART STATEMENT

The present invention relates to an ink-jet printer in which an array of ink-particles is generated from a pressurized ink by a nozzle tube to move toward a work piece, is charged with electricity by energized electrodes and is deflected by an electrically controllably energized deflecting plate so that each of the ink-particles injected from the ink-jet printer reaches a desirable position on the work piece to be printed.

A basic structure of the ink-jet printer as above mentioned is disclosed by, for example, U.S. Pat. No. 4,083,053.

As shown in FIG. 4, a conventional ink-jet printer has a suction pump 7 so that a part of the array of ink-particles which is not used to print the work piece and an air in a gutter 6 for receiving the part of the array of ink particles are taken into an ink-tank 1 from a printing head 9. The part of the array of ink-particles which is not used to print the work piece is contained again in the ink-tank 1, but, the air taken from the gutter into the ink-tank 1 is discharged from the ink-tank 1 to the atmosphere through a filter 16 in which an organic solvent contained by and generated from the ink is absorbed by an activated charcoal or the like. The ink is supplied to a nozzle tube 5 from the ink-tank 1 by an ink-pump 2 through an ink-pressure regulator 4. An air compressor 15 supplies a pressurized air into the printing head 9 from the atmosphere to prevent a penetration of undesirable substance into the printing head 9.

OBJECT AND SUMMARY OF THE INVENTION

An object of the present invention is to provide an ink-jet printer in which the penetration of undesirable substance into the printing head is securely prevented and an ink-mist generated from the ink-particles in the printing head is effectively taken from the inside of the printing head including the outside of the gutter into the ink-tank.

According to the present invention, an ink-jet printer comprises, an ink tank for receiving an ink, a printing head including a nozzle for injecting an array of ink-particles, electrode means for charging the ink-particles with electricity, electrically controllably energized deflecting means for deflecting the electrically charged ink-particles so that each of the ink-particles injected from the ink-jet printer reaches a desirable position on a work piece to be printed, and a gutter for receiving a part of the array of ink-particles which is not used to print the work piece, and pump means for taking the part of the array of ink-particles through the gutter into the ink tank, wherein an air in the printing head is taken into the pump means through the gutter, and the ink-jet printer further comprises a feed back path which opens to an inside further comprises a feed back path which opens to an inside of the printing head at an outside of the gutter to return the air taken from the printing head by the pump means through the gutter to the inside of the printing head at the outside of the gutter.

Since the ink-jet printer comprises the feed back path which opens to the inside of the printing head at the outside of the gutter to return the air taken from the printing head by the pump means through the gutter to the inside of the printing head at the outside of the gutter, the air circulates from the outside of the gutter in the inside of the printing head through an inside of the gutter, the pump means and the feed back path to the inside of the printing head at the outside of the gutter. Therefore, the atmosphere is prevented from flowing from an outside of the printing head to the inside of the printing head so that the penetration of undesirable substance into the printing head is securely prevented, and the ink-mist generated from the ink-particles at the outside of the gutter in the printing head is effectively taken from the inside of the printing head including the outside of the gutter into the ink-tank by the air flow from the outside of the gutter to the inside of the gutter. A decrease in flow rate of the vaporized ink-solvent from the ink-jet printer to the outside thereof causes a decrease in running cost of the ink-jet printer.

DETAILED DESCRIPTION OF THE PREFERRED EMBODIMENTS

Figure 1:
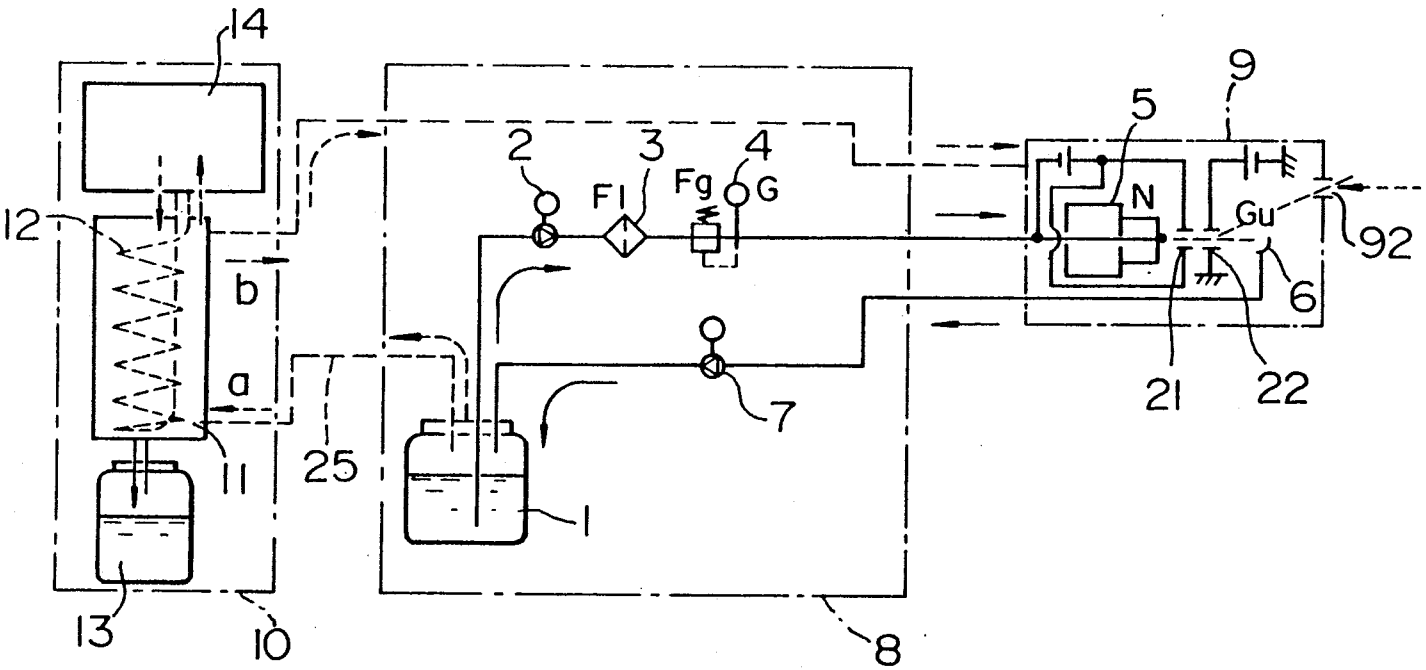
FIG. 1 is a schematic view showing a first embodiment of the present invention.

In an ink-jet printer as shown in FIG. 1, an ink tank 1, an ink feed pump 2, an ink filter 3, an ink pressure regulator 4, and a longitudinally vibrating nozzle tube 5 are connected in series to generate an array of ink-particles from the longitudinally vibrating nozzle tube 5. A gutter 6 receives a part of the array of ink-particles which is not deflected by a deflecting plate pair 22 and is not used to print a work piece (not-shown). A part of the array of ink-particles are charged with electricity by a voltage-variable electrode pair 21 to control a moving direction of the ink-particles, and subsequently, the electrically charged ink-particles are deflected by the deflecting plate pair 22 whose one plate is electrically energized to deflect a direction of the part of the array of ink-particles toward the work piece by an electrical field strength in the deflecting plate pair 22. Another part of the array of ink-particles which is not charged with electricity by the electrode pair 21 moves towards the utter.

Figure 9:
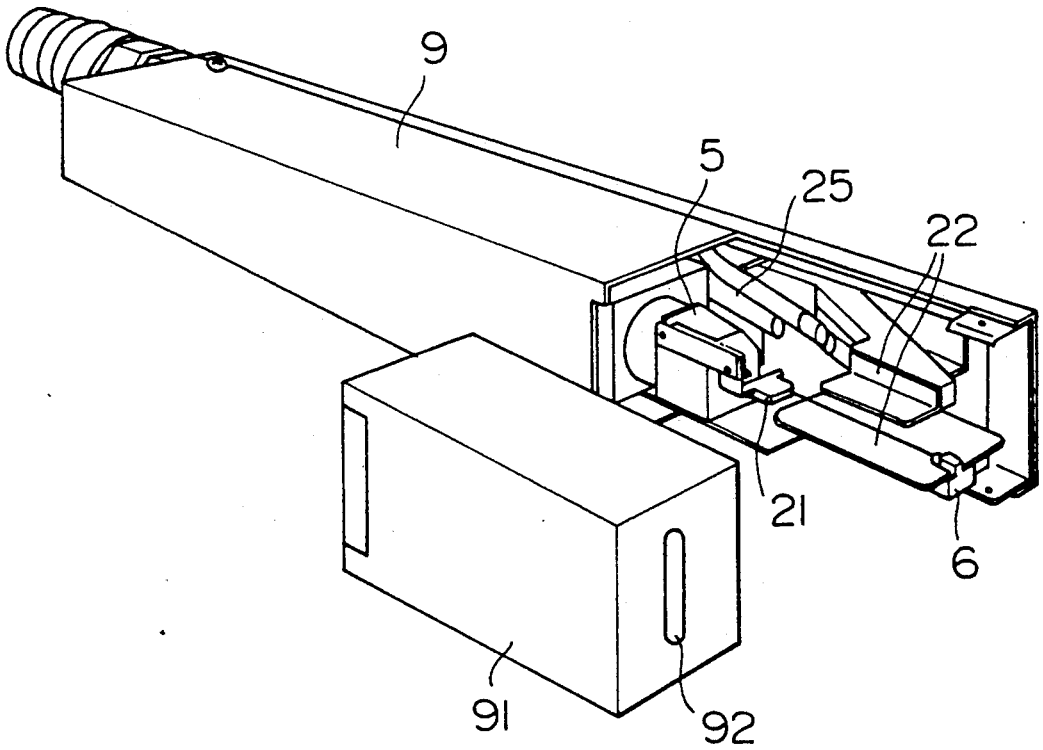
FIG. 9 is an oblique projection view showing in detail a structure in a printer head according to the present invention.

An ink suction pump 7 feeds the part of the array of ink-particles which is not deflected by the deflecting plate pair 22 and is not used to print the work piece from the gutter 6 to the ink tank 1. The ink tank 1, the ink feed pump 2, the ink filter 3, the ink pressure regulator 4, and the ink suction pump 7 forms an ink circulation device 8. A printing head 9 includes the longitudinally vibrating nozzle tube 5, the electrode pair 21, the deflecting plate pair 22, the gutter 6 and an opening 92 through which a part of the array of ink-particles which is deflected by the deflecting plate pair 22 and is used print on the work piece. A forward end of the longitudinally vibrating nozzle tube 5, the electrode pair 21, the deflecting plate pair 22, the gutter 6 are covered by a head cover 91, as shown in detail in FIG. 9.

Figure 2:
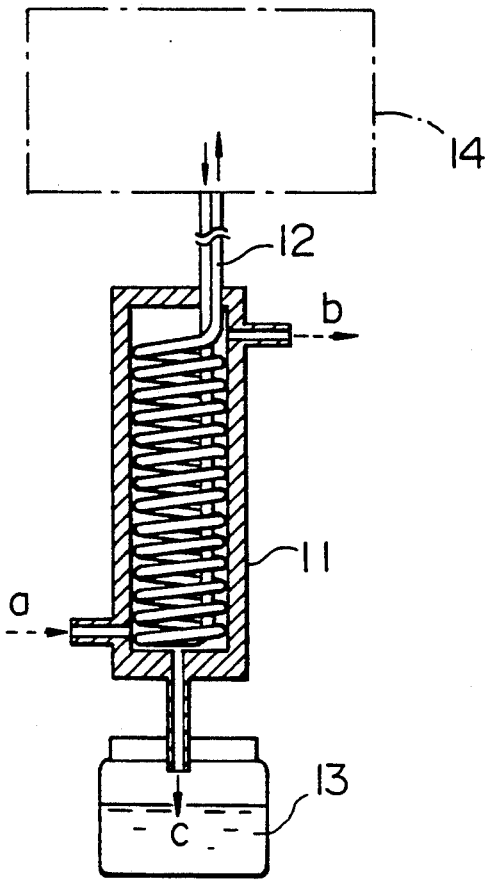
FIG. 2 is a schematic partially cross-sectional view showing ink-solvent absorbing device.
Figure 3:
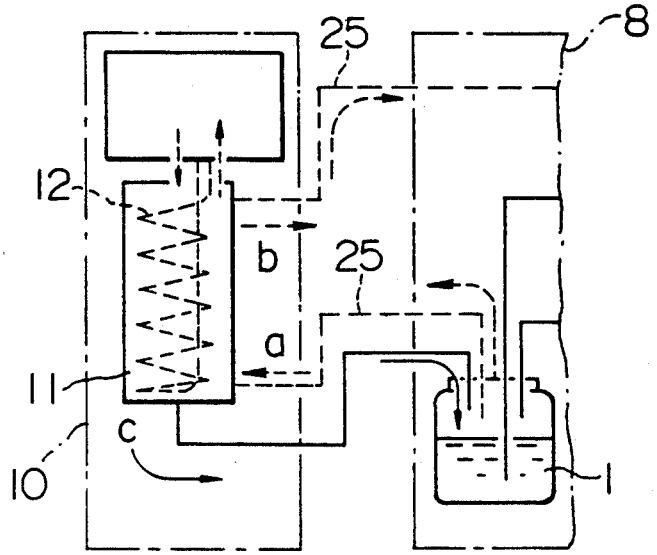
FIG. 3 is a schematic view showing another embodiment of the ink-solvent absorbing device.
Figure 4:
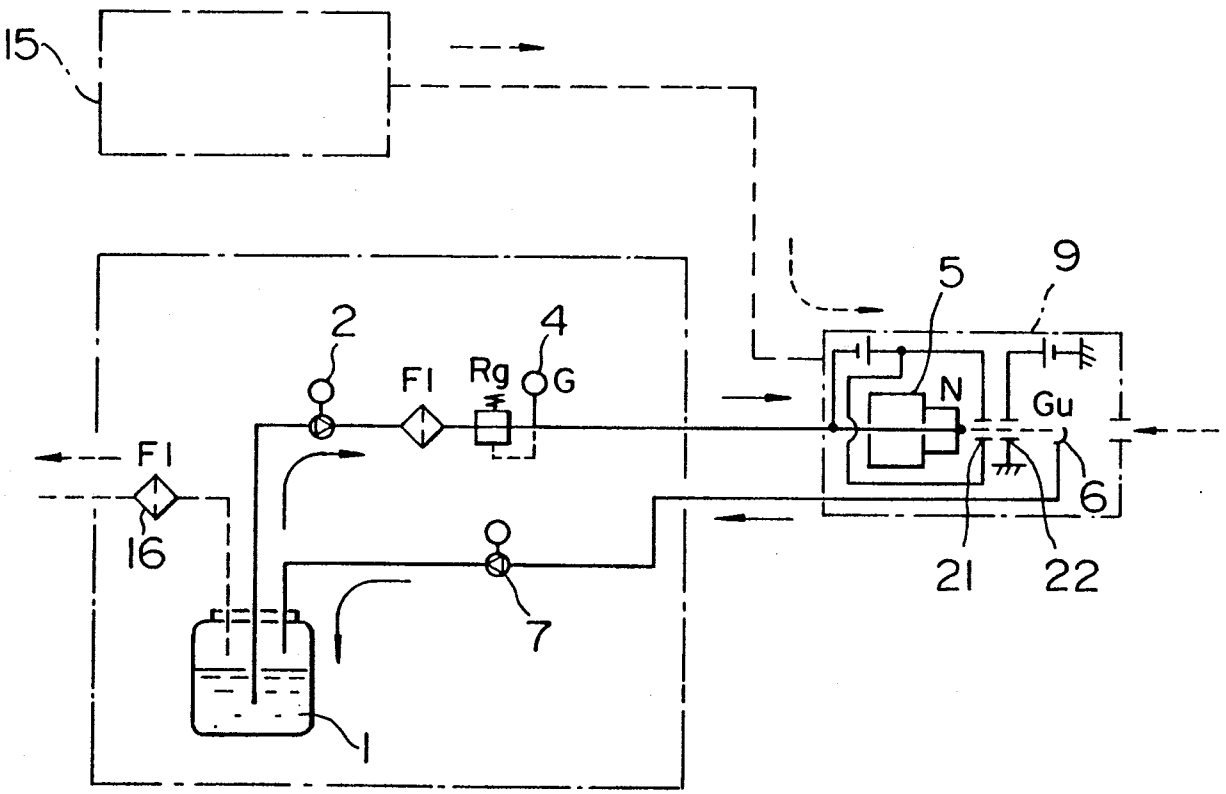
FIG. 4 PRIOR ART
FIG. 4 is a schematic view showing a conventional ink-jet printer.

A feed back path 25 extends from an upper air portion in the ink tank 1 through an ink-solvent absorbing tank 11 to the outside of the gutter 6 in the printing head 9. The feed back path 25 may extend directly from the ink suction pump 7 or from the ink tank 1 to the outside of the gutter 6 in the printing head 9 without passing the ink-solvent absorbing tank 11, in all of the embodiment of the present invention. As shown in FIGS. 2, the ink-solvent absorbing tank 11 includes a cooling pipe 12 into which a refrigerant expanded adiabatically through an orifice (not shown) after being compressed by a cooling pump 14 and being cooled by a heat exchange between the refrigerant and the atmosphere is supplied to cool the cooling pipe 12. An ink solvent, particularly, an organic solvent, which was vaporized from the ink and is included by the air supplied from the gutter 6 is cooled and liquified by the cooling pipe 12 in the ink-solvent absorbing tank 11 at about 5° C. so that the ink-solvent is separated from the air supplied from the gutter 6. The air after the separation of the ink-solvent thereform is supplied to the outside of the gutter 6 in the printing head 9, and the separated ink-solvent flows into an ink-solvent container 13. The absorbed ink-solvent in the ink-solvent container 13 may be supplied into the ink tank 1 as shown in FIG. 3. The ink-solvent absorbing tank 11, the cooling pipe 12, the ink-solvent container 13 and the cooling pump 14 forms an ink-solvent absorbing device 10. Since the air circulates among the inside of the gutter 6 in the printing head 9, the ink suction pump 7, the ink-solvent absorbing device 10 and the outside of the gutter 6 in the printing head 9, the ink-solvent is prevented from flowing out from the ink-let printer.

If the absorbed ink-solvent in the ink-solvent container 13 is supplied into the ink tank 1 as shown in FIG. 3, a viscosity of the ink is not changed by a vaporization or separation of the ink-solvent from the ink and the ink-solvent does not need to be supplied into the ink tank 1 from the outside of the ink-jet printer to adjust the viscosity of the ink.

Figure 5:
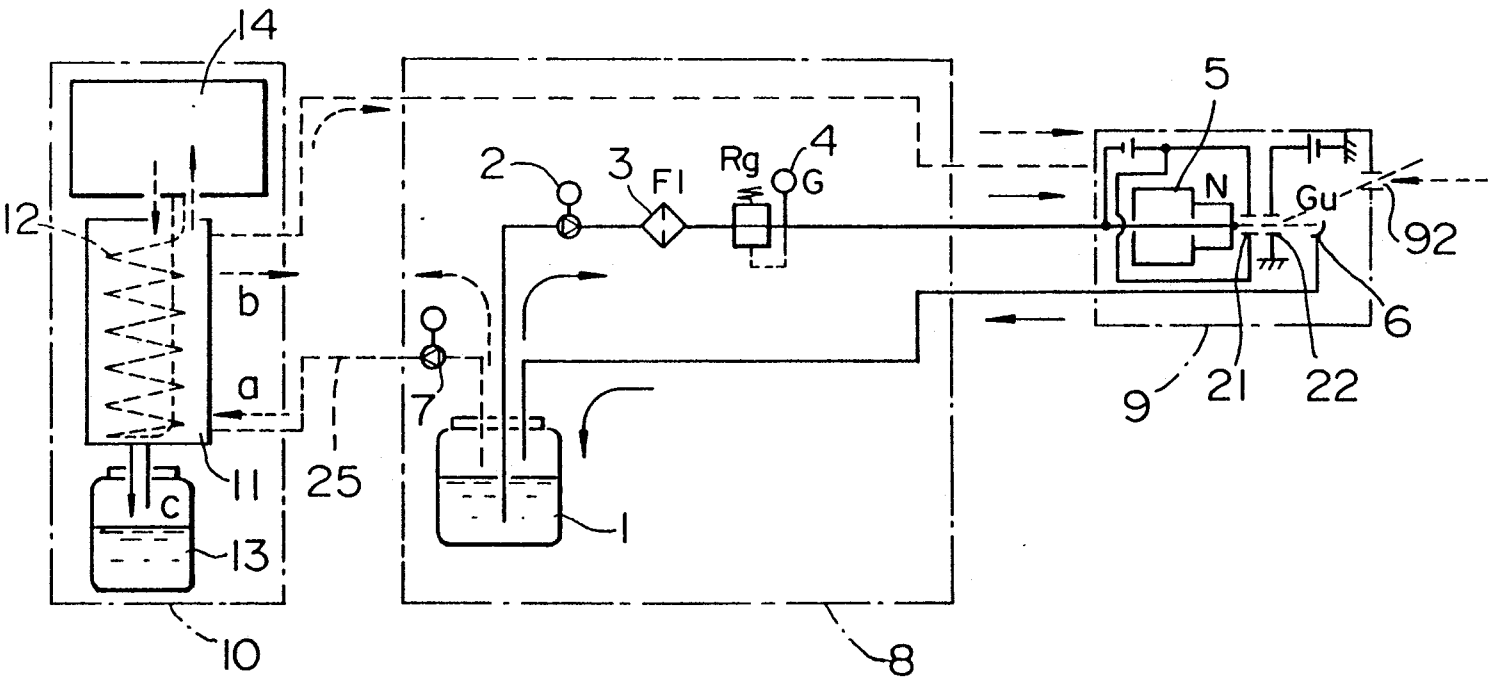
FIG. 5 is a schematic view showing a second embodiment of the present invention.
Figure 6:
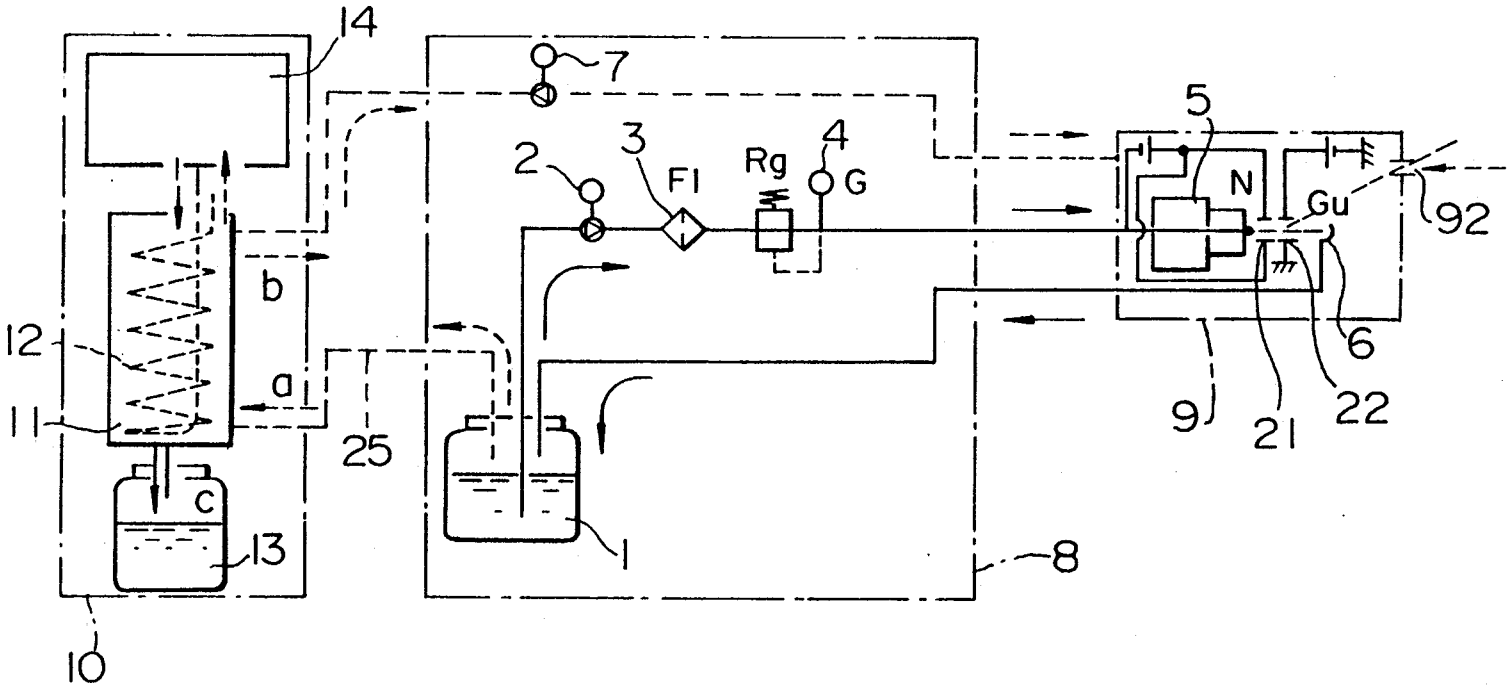
FIG. 6 is a schematic view showing a third embodiment of the present invention.
Figure 7:
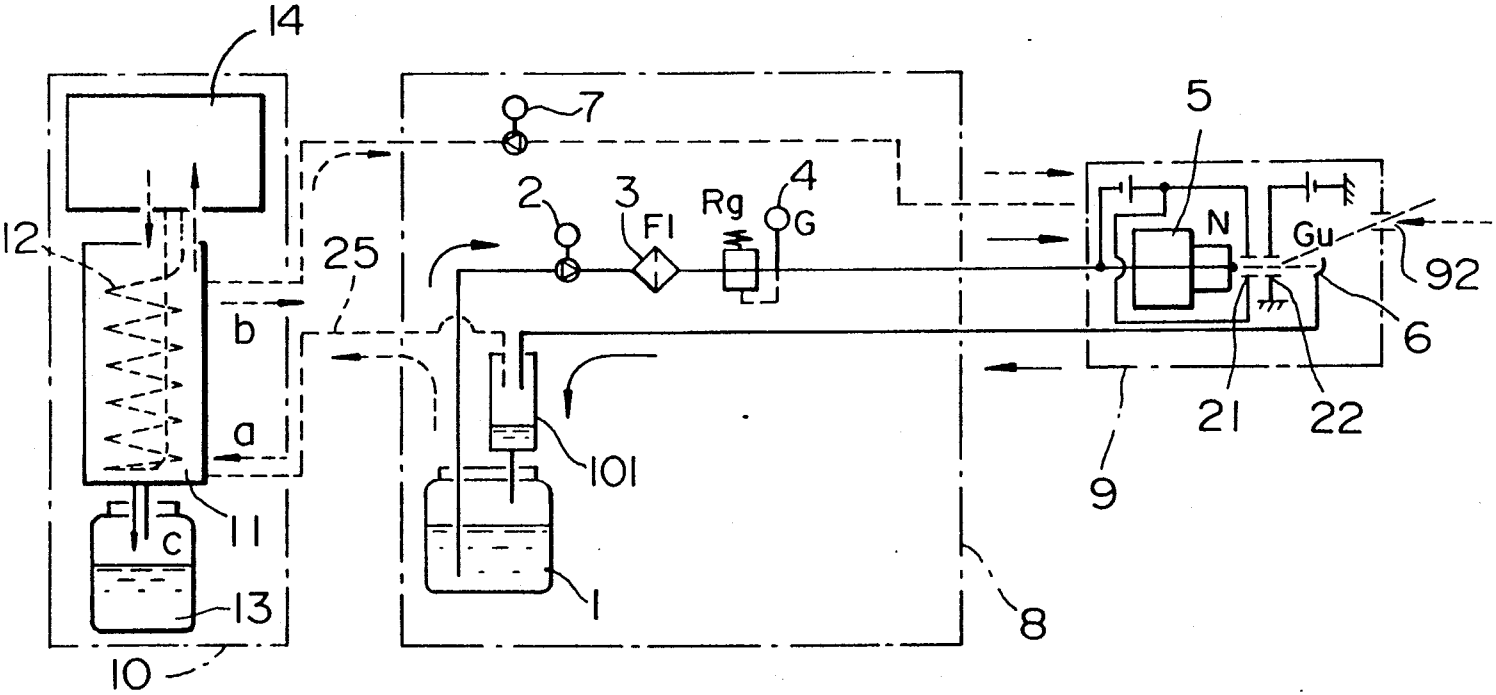
FIG. 7 is a schematic view showing a fourth embodiment of the present invention.
Figure 10:
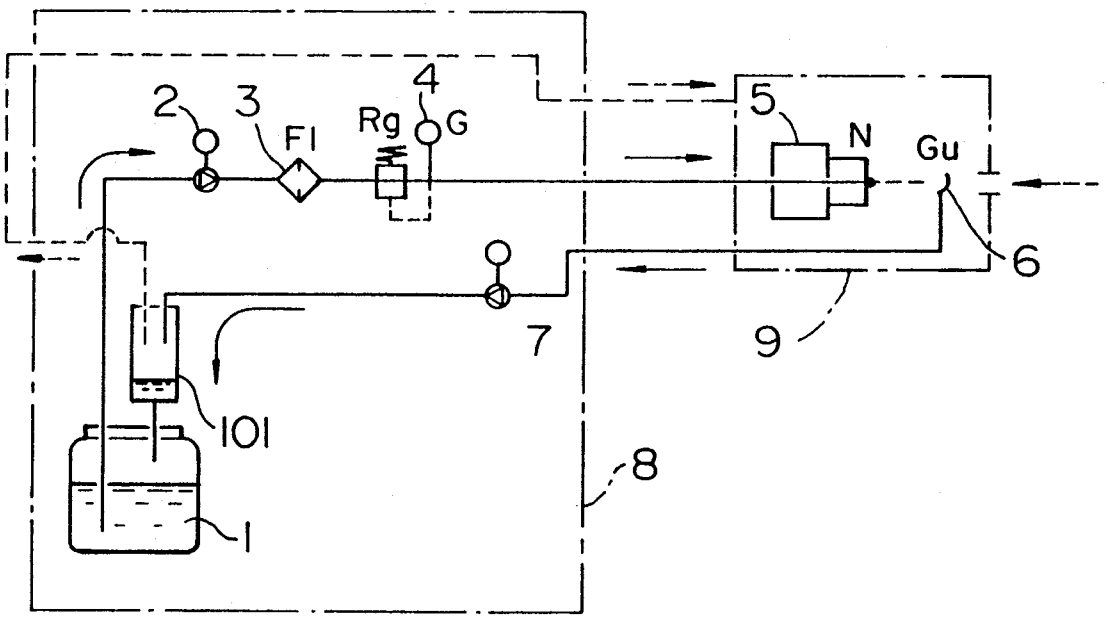
FIG. 10 is an oblique projection view showing an inside of the printer head according to the present invention.
Figure 11:
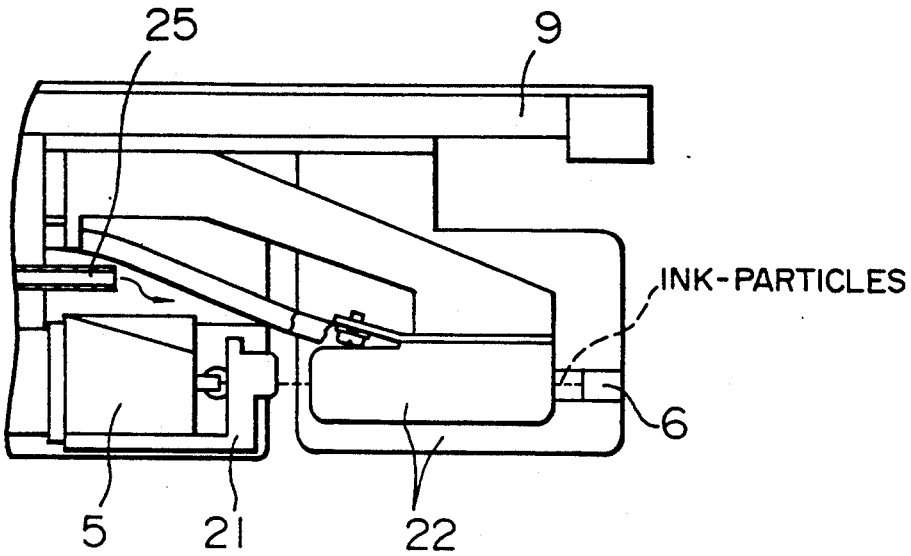
FIG. 11 is a partially cross-sectional view showing the inside of the printer head.
Figure 12:
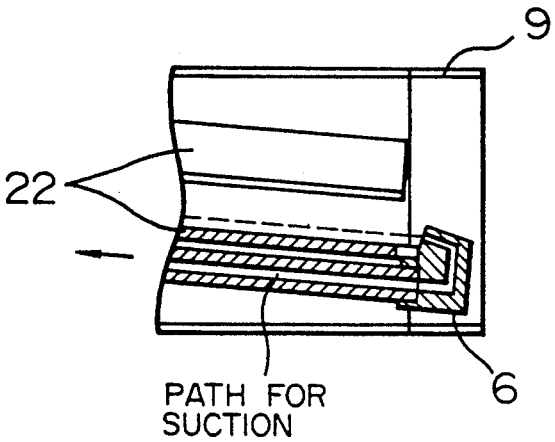
FIG. 12 is a partially cross-sectional view showing a structure of a gutter according to the present invention.

As shown in FIG. 5, the ink suction pump 7 may be mounted on the feed back path 25 between the upper air portion in the ink tank 1 and the ink-solvent absorbing tank 11. As shown in FIG. 6, the ink suction pump 7 may be mounted on the feed back path 25 between the outside of the gutter 6 in the printing head 9 and the ink-solvent absorbing tank 11. As shown in FIG. 7, the feed back path 25 may be extend from a liquid-air separating device 101 to the outside of the gutter 6 in the printing head 9 without passing the ink tank 1. In the liquid air separating device 101, the ink from the gutter 6 is stored at a bottom portion of the liquid-air separating device 101 and flows through an orifice for limiting a flow rate of the ink into the ink tank 1 so that the inside of the liquid-air separating device 101 and that of the ink tank 1 are partitioned from each other by the ink stored at the bottom portion of the liquid-air separating device 101. The feed back path 25 extends from an upper air portion in the liquid-air separating device 101 through the ink-solvent absorbing tank 11 to the outside of the gutter 6 in the printing head 9. As shown in FIG. 10, the feed back path 25 may be extend from the liquid-air separating device 101 to the outside of the gutter 6 in the printing head 9 without passing the ink tank 1 and the ink-solvent absorbing device 10 so that a forward end of the feed back path 25 is arranged adjacently to a path of the array of the ink-particles.

Figure 8:
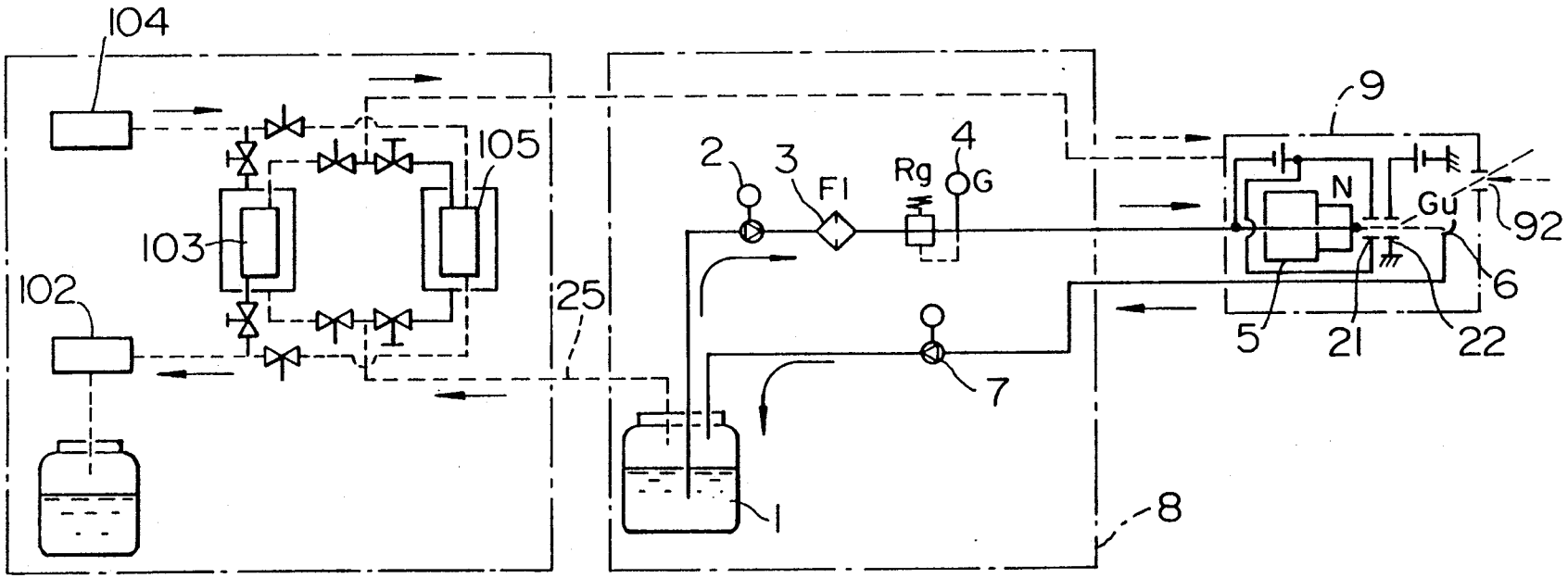
FIG. 8 is a schematic view showing a fifth embodiment of the present invention.

As shown in FIG. 8, the ink-solvent may be absorbed by one of a pair of activated charcoal type ink-solvent absorbing devices 103 mounted on the feed back path 25. When the one of the pair of activated charcoal type ink-solvent absorbing devices 103 is absorbing the ink-solvent, the ink-solvent is taken out from another one of the pair of activated charcoal type ink-solvent absorbing devices 103 by a steam from a steam generator 104, and is cooled and liquified in a condensor 102, so that each of the activated charcoal type ink-solvent absorbing devices 103 is used alternatively to absorb the ink-solvent. Valves closed when the one of the pair of activated charcoal type ink-solvent absorbing devices 103 is absorbing the ink-solvent are opened when ink-solvent is taken out therefrom. The other valves opened when the one of the pair of activated charcoal type ink-solvent absorbing devices 103 is absorbing the ink-solvent are closed when ink-solvent is taken out therefrom.

What is claimed is:

1. An ink-jet printer comprising, an ink tank for receiving an ink, a printing head including a nozzle for generating an array of ink-particles, electrode means for charging the ink-particles with electricity, electrically energized deflecting means for deflecting the electrically charged ink-particles so that a part of the ink-particles ejected from the ink-jet printer reaches a desirable position on a work piece to be printed, and a gutter for catching another part of the array of ink-particles which is not used to print the work piece, and pump means for taking the another part of the array of ink-particles through the gutter into the ink tank, wherein an air in the printing head is taken into the pump means through the gutter, the air is separated from the ink, and the separated air is returned to an inside of the printing head.

2. An ink-jet printer comprising, an ink tank for receiving an ink, a printing head including a nozzle for generating an array of ink-particles, electrode means for charging the ink-particles with electricity, electrically energized deflecting means for deflecting the electrically charged ink-particles so that a part of the ink-particles ejected from the ink-jet printer reaches a desirable position on a work piece to be printed, and a gutter for catching another part of the array of ink-particles which is not used to print the work piece, and pump means for taking the another part of the array of ink-particles through the gutter into the ink tank, wherein an air in the printing head is taken into the pump means through the gutter, and the ink-jet printer further comprises a feed back path which opens to an inside of the printing head at an outside of the gutter to return the air taken from the printing head through the gutter by the pump means to the inside of the printing head at the outside of the gutter.

3. An ink-jet printer according to claim 2, wherein the ink-jet printer further comprises an ink-solvent absorbing means mounted on the feed back path to absorb an ink-solvent from the air taken from the inside of the printing head through the gutter into the feed back path by the pump means.

4. An ink-jet printer according to claim 2, wherein the ink-jet printer further comprises a liquid-air separating means for separating the ink from the air taken from the inside of the printing head through the gutter by the pump means to supply the separated ink into the ink tank and to supply the separated air into the feed back path.

5. An ink-jet printer according to claim 2, wherein the air flows into the feed back path through the ink tank.

6. An ink-jet printer according to claim 2, wherein the ink-jet printer further comprises a liquid-air separating means for separating the ink from the air taken from the inside of the printing head through the gutter by the pump means to supply the separated ink into the ink tank and to supply the separated air into the feed back path, and the air separated from the ink flows into the feed back path with bypassing the ink tank.

7. An ink-jet printer according to claim 2, wherein the pump means is mounted on the feed back path.

8. An ink-jet printer according to claim 3, wherein the pump means is mounted on the feed back path between the ink tank and the ink-solvent absorbing means.

9. An ink-jet printer according to claim 3, wherein the pump means is mounted on the feed back path between the outside of the gutter in the printing head and the ink-solvent absorbing means.

10. An ink-jet printer according to claim 4, wherein the liquid-air separating means stores the ink from the gutter at a bottom portion of the liquid-air separating means so that an inside of the liquid-air separating means and that of the ink tank are partitioned from each other by the ink stored at the bottom portion of the liquid-air separating means.

11. An ink-jet printer according to claim 3, wherein the ink-solvent absorbing means absorb the ink-solvent from the air by cooling and liquefying the ink-solvent in the air.

12. An ink-jet printer according to claim 3, wherein the ink-solvent absorbing means includes an activated charcoal for absorbing the ink-solvent from the air.

13. An ink-jet printer according to claim 2, wherein the feed back path extends to the inside of the printing head so that the array of ink-particles passes adjacently to a forward end of the feed back path is arranged.

14. An ink-jet printer according to claim 2, wherein the feed back path opens to the inside of the printing head at an upstream side of the gutter in a moving direction of the another part of the array of ink-particles.

* * * * *